US007909706B2

(12) United States Patent
Cole et al.

(10) Patent No.: US 7,909,706 B2
(45) Date of Patent: Mar. 22, 2011

(54) GOLF CLUB HEAD WITH HOSEL WEIGHT

(75) Inventors: Eric V. Cole, Phoenix, AZ (US); John A. Solheim, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 112 days.

(21) Appl. No.: 12/202,593

(22) Filed: Sep. 2, 2008

(65) Prior Publication Data

US 2010/0056293 A1 Mar. 4, 2010

(51) Int. Cl.
*A63B 53/02* (2006.01)

(52) U.S. Cl. ..... 473/305; 473/308; 473/324

(58) Field of Classification Search ..... 473/305, 473/307–310, 324, 334
See application file for complete search history.

(56) References Cited

U.S. PATENT DOCUMENTS

| | | | | | |
|---|---|---|---|---|---|
| 1,550,647 | A | | 8/1925 | Mattern | |
| 1,553,867 | A | * | 9/1925 | Maas | 473/308 |
| 1,829,900 | A | * | 11/1931 | Johnson | 473/308 |
| 1,905,406 | A | * | 4/1933 | Barrett | 473/308 |
| 2,067,556 | A | | 1/1937 | Wettlaufer | |
| 2,608,409 | A | * | 8/1952 | Pinkerton | 473/256 |
| 3,625,513 | A | | 12/1971 | Ballmer | |
| 3,680,870 | A | * | 8/1972 | Burnett et al. | 473/256 |
| 4,811,950 | A | * | 3/1989 | Kobayashi | 473/335 |
| 4,854,582 | A | | 8/1989 | Yamada | |
| 4,948,132 | A | | 8/1990 | Wharton | |
| 5,009,423 | A | * | 4/1991 | Okumoto et al. | 473/308 |
| 5,078,400 | A | | 1/1992 | Desbiolles et al. | |
| 5,165,688 | A | | 11/1992 | Schmidt et al. | |
| 5,335,914 | A | | 8/1994 | Long | |
| 5,839,973 | A | | 11/1998 | Jackson | |
| 5,885,169 | A | | 3/1999 | Ishizuka | |
| 5,906,549 | A | | 5/1999 | Kubica | |
| 5,916,041 | A | | 6/1999 | Antonious | |
| 5,989,134 | A | | 11/1999 | Antonious | |
| 5,993,325 | A | * | 11/1999 | Heyer | 473/256 |
| 6,080,069 | A | | 6/2000 | Long | |
| 6,123,627 | A | | 9/2000 | Antonious | |
| 6,251,028 | B1 | | 6/2001 | Jackson | |
| 6,287,214 | B1 | | 9/2001 | Satoh | |
| 6,575,843 | B2 | | 6/2003 | McCabe | |
| 6,652,391 | B1 | | 11/2003 | Kubica et al. | |
| 6,855,067 | B2 | | 2/2005 | Solheim et al. | |
| 7,413,518 | B2 | | 8/2008 | Cole et al. | |
| 7,704,158 | B2 | | 4/2010 | Burrows | |
| 2002/0037773 | A1 | * | 3/2002 | Wood et al. | 473/246 |
| 2002/0077193 | A1 | | 6/2002 | Takeda | |
| 2003/0207720 | A1 | | 11/2003 | Sery | |
| 2004/0063515 | A1 | | 4/2004 | Boone | |
| 2005/0124431 | A1 | | 6/2005 | Huang et al. | |
| 2005/0245325 | A1 | | 11/2005 | Gilbert et al. | |
| 2006/0035721 | A1 | | 2/2006 | Knutson et al. | |
| 2006/0270487 | A1 | * | 11/2006 | Tu Teng | 473/256 |

(Continued)

FOREIGN PATENT DOCUMENTS

WO 2009/035345 A1 3/2009

*Primary Examiner* — Stephen L. Blau

(57) ABSTRACT

A golf club head includes a body having a front face for impacting a golf ball and a hosel having a bore for receiving one end of a golf club shaft. The body including the hosel may be made of a material such as steel. A hosel weight mounted on the hosel may be made of another material such as tungsten which has a greater density than the material forming the body.

33 Claims, 4 Drawing Sheets

U.S. PATENT DOCUMENTS

2008/0280696 A1 11/2008 Lau
2009/0062029 A1 3/2009 Stites et al.
2009/0163287 A1 6/2009 Vald'Via et al.
2010/0022323 A1* 1/2010 Thomas et al. ..... 473/307
2010/0035701 A1 2/2010 Kusumoto
2010/0197422 A1 8/2010 Thomas et al.

* cited by examiner

GOLF CLUB HEAD WITH HOSEL WEIGHT

BACKGROUND

This invention relates generally to golf equipment and, in particular, to a golf club head.

U.S. Pat. No. 6,206,790 to Kubica et al discloses an iron-type golf club head with a heel portion, a toe portion and a front face arranged for impact with a golf ball. In one example, golf club heads such as shown in the Kubica et al patent may be designed so that their center of gravity is directly behind or near the golf ball impact zone, which may be located at the geometric center of the front face. The moment of inertia of a golf club head can be increased by positioning more weight in the heel and toe portions of the golf club head.

DRAWINGS

DESCRIPTION

Figure 1:
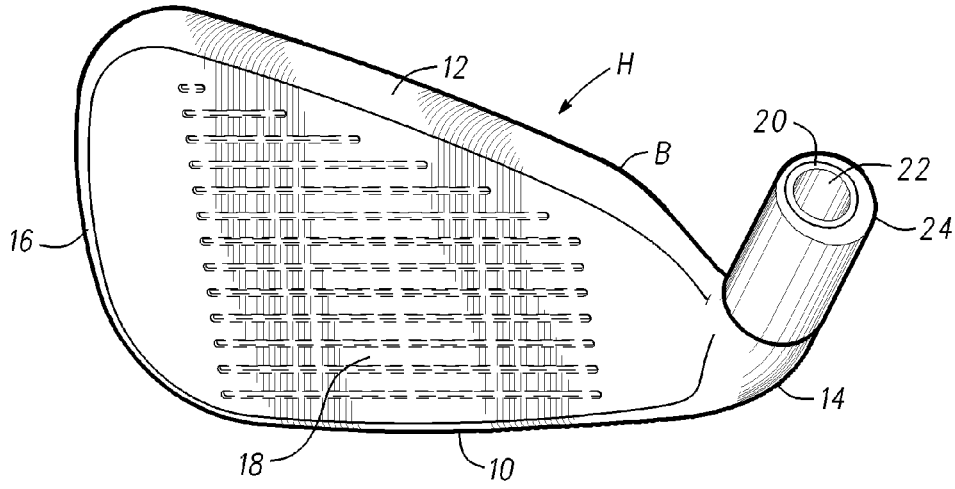
FIG. 1 is a perspective view of a golf club head incorporating one embodiment of a hosel weight according to the present invention.
Figure 2:
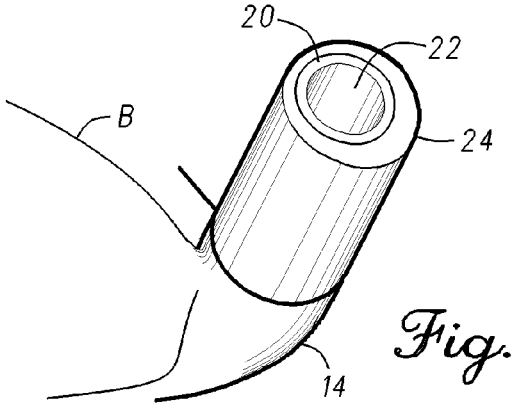
FIG. 2 is an enlarged view of a heel portion of the golf club head of FIG. 1.
Figure 3:
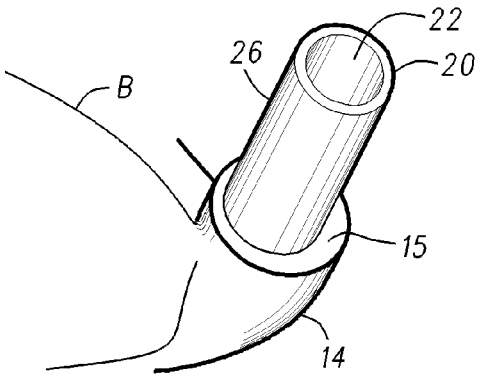
FIG. 3 is an enlarged view similar to FIG. 2 with the hosel weight removed.
Figure 4:
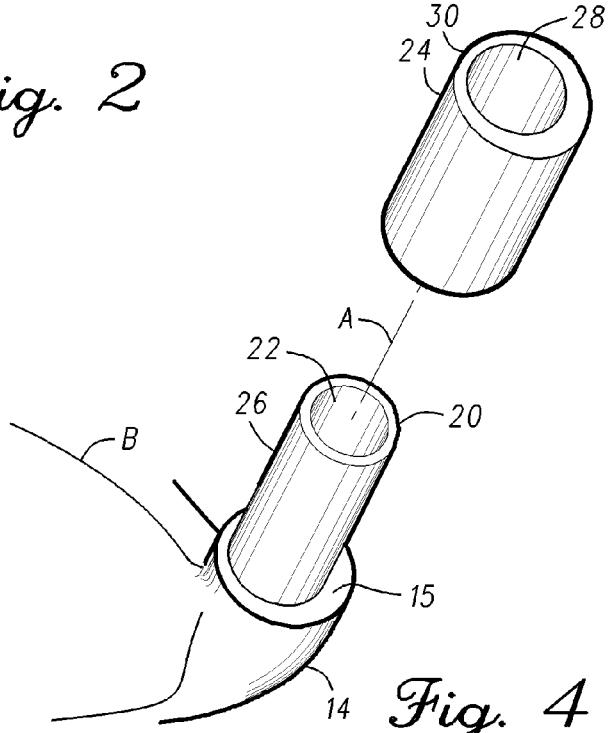
FIG. 4 is an exploded view of the heel portion of the golf club head shown in FIG. 2.

Referring to FIGS. 1-4, an iron-type golf club head H includes a body B with a sole 10, a top edge 12, a heel portion 14, a toe portion 16 and a front face 18 arranged for impacting a golf ball. Front face 18 extends between the heel and toe portions 14, 16. The golf club head H also includes a hosel 20 with a generally cylindrical shape on the heel portion 14 of the body B. The hosel 20 has a longitudinal axis A and a bore 22 defined by its peripheral wall 26 for receiving one end of a golf club shaft (not shown). The hosel bore 22 is concentric with the longitudinal axis A. The heel portion 14 of the body B includes a shoulder 15 adjacent a lower end of the hosel 20. Mounted on the hosel 20 is a hosel weight 24. The hosel weight 24 is formed as a generally cylindrical sleeve and may be fastened to the hosel 20 by conventional means such as adhesive or mechanical devices. Alternatively, the hosel 20 and the hosel weight 24 may be conical instead of cylindrical. Although FIGS. 1-4 may depict an iron-type golf club head, the apparatus and methods described herein may be applicable to other suitable types of golf club heads (e.g., driver-type golf club heads, fairway wood-type golf club heads, hybrid-type golf club heads, wedge-type golf club heads, putter-type golf club heads, etc.).

Figure 5:
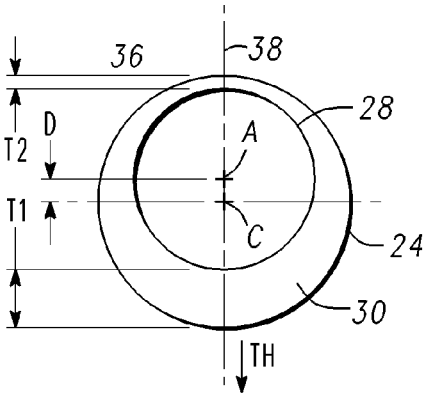
FIG. 5 is an enlarged end view of the hosel weight in one position.

Turning to FIG. 5, the hosel weight 24 has a longitudinal axis C and a generally cylindrical bore 28 which receives the hosel 20. When the hosel weight 24 is mounted on the hosel 20, its bore 28 is concentric with the longitudinal axis A and the hosel weight 24 contacts the shoulder 15. The hosel weight bore 28 is offset (i.e., not concentric) with respect to the longitudinal axis C of the hosel weight 24. Therefore, a peripheral wall 30 of the hosel weight 24 that defines the bore 28 has a varying thickness dimension. As shown in FIG. 5, the peripheral wall 30 has a thickness dimension T1 at its thickest point and a thickness dimension T2 at its thinnest point. This results in the hosel weight 24 having significantly more mass in the vicinity of the thickness dimension T1 than in the vicinity of the thickness dimension T2. As shown in FIG. 5, the hosel weight 24 may be positioned so that its longitudinal axis C is offset from the hosel longitudinal axis A by a distance D in a direction TH extending generally from the toe portion 16 toward the heel portion 14.

Figure 6:
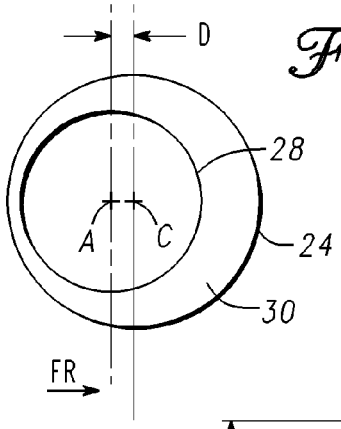
FIG. 6 is an enlarged end view of the hosel weight in another position.
Figure 7:
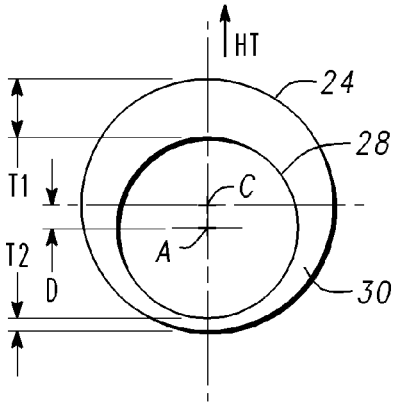
FIG. 7 is an enlarged end view of the hosel weight in a further position.
Figure 8:
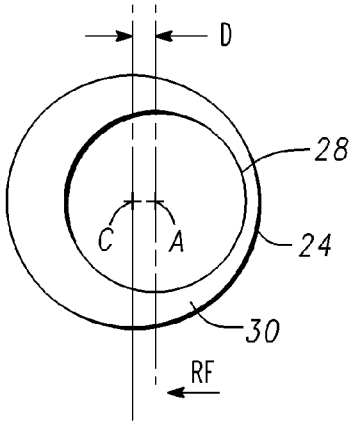
FIG. 8 is an enlarged end view of the hosel weight in another position.

Referring to FIGS. 6-8, it will be understood that the hosel weight 24 may be positioned so that its thickness dimension T1 is located at any point along the circumference of the hosel 20. For example, the hosel weight 24 may be positioned as shown in FIG. 6 so that its longitudinal axis C is offset from the hosel longitudinal axis A by the distance D in a direction FR extending generally rearwardly relative to the front face 18. The hosel weight 24 may also be positioned as shown in FIG. 7 so that its longitudinal axis C is offset from the hosel longitudinal axis A by the distance D in a direction HT extending generally from the heel portion 14 toward the toe portion 16. The hosel weight 24 may be positioned as shown in FIG. 8 so that its longitudinal axis C is offset from the hosel longitudinal axis A by the distance D in a direction RF extending generally forwardly relative to the front face 18. Therefore, the hosel weight 24 may be positioned with its thickness dimension T1 located on the forward side, the rearward side, the toe side or the heel side of the hosel 20 or anywhere in between those positions. As described in detail below, the position of the thickness dimension T1 may affect the center of gravity and/or the moment of inertia of the club head H.

In one embodiment, the body B including the hosel 20 is made of a metallic material such as steel having a first density while the hosel weight 24 is made of a metallic material such as tungsten having a second density which is greater than the first density. Alternatively, in other embodiments, the body B including the hosel 20 is made of titanium and the hosel weight 24 is made of either zirconium or tungsten. In further embodiments, the body B including the hosel 20 is made of composite material and the hosel weight 24 is made of either metal or another composite material. It is preferred, but not required, that the material (i.e. tungsten or zirconium) forming the hosel weight 24 will have a higher density than the material (i.e. steel or titanium) forming the body B including the hosel 20.

The hosel weight 24 adds mass to the hosel 20 which increases the moment of inertia of the club head H. The amount of mass added to the hosel 20 is significantly increased and the moment of inertia of the club head H is significantly increased when the hosel weight 24 is made of denser material as described above than the body B. With the hosel weight 24 mounted on the hosel 20, the center of gravity of the club head H is shifted toward the heel portion 14 of the body B. When comparing the positions of the hosel weight 24 as shown in FIGS. 5 and 7, it will be realized that the club head center of gravity will be shifted farther toward the body heel portion 14 and the club head moment of inertia will be increased more with the hosel weight 24 in the position shown in FIG. 5 than with the hosel weight 24 in the position shown in FIG. 7. Depending on the particular orientation of the hosel weight 24 on the hosel 20, the center of gravity of the club head H may also be shifted slightly forward or rearward. For example, when the hosel weight 24 is in the orientation shown in FIG. 6, the club head center of gravity is shifted slightly rearward and, when the hosel weight 24 is in the orientation shown in FIG. 8, the club head center of gravity is shifted slightly forward.

If a golfer desires the club head H to have its center of gravity shifted as far toward the heel portion 14 as possible in addition to having its moment of inertia maximized, the hosel weight 24 should be in the position shown in FIG. 5. If a golfer desires the club head H to have its center of gravity shifted as far rearward as possible, the hosel weight 24 should be in the position shown in FIG. 6 and, if a golfer desires the club head H to have its center of gravity shifted as far forward as possible, the hosel weight 24 should be in the position shown in FIG. 8. An optimal position for the hosel weight 24 may be when it is rotated approximately 45 degrees counterclockwise from the position shown in FIG. 5 so that its thickness dimension T1 is located halfway between the positions shown in FIGS. 5 and 6.

While the above examples may describe and depict the hosel weight 24 being mounted on the body B in a particular manner (e.g., FIG. 2), the club head H may be manufactured so that both the shoulder 15 and the hosel weight 24 vary in thickness dimension. In another example, the hosel 20 and the hosel weight 24 may be concentric and thus share a common longitudinal axis (e.g., the hosel longitudinal axis A). In a further example, the shoulder 15 may vary in thickness dimension while the hosel weight 24 may have a substantially uniform thickness dimension. In this example, the shoulder 15 may vary in thickness dimension in a similar manner as shown in FIGS. 5, 6, 7, and/or 8. Referring to FIGS. 5-8, for example, the shoulder 15 may have a first thickness dimension T1 and a second thickness dimension T2.

Figure 9:
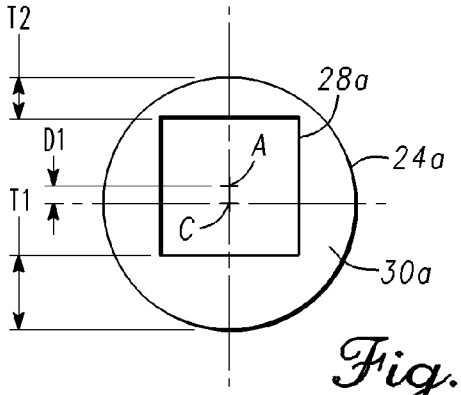
FIGS. 9-11 are enlarged end views similar to FIG. 5 showing different embodiments of the hosel weight.
Figure 10:
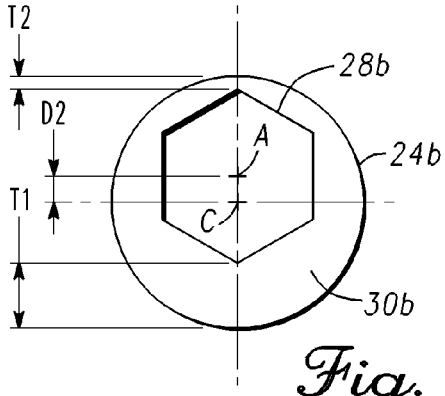
Figure 11:
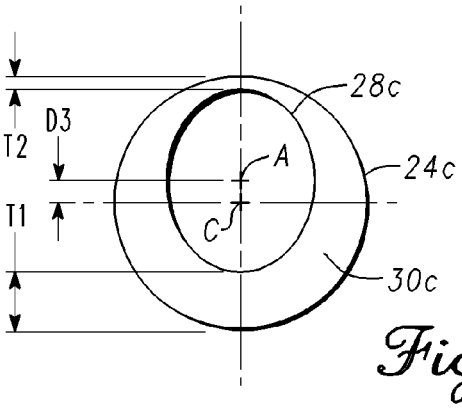
Figure 12:
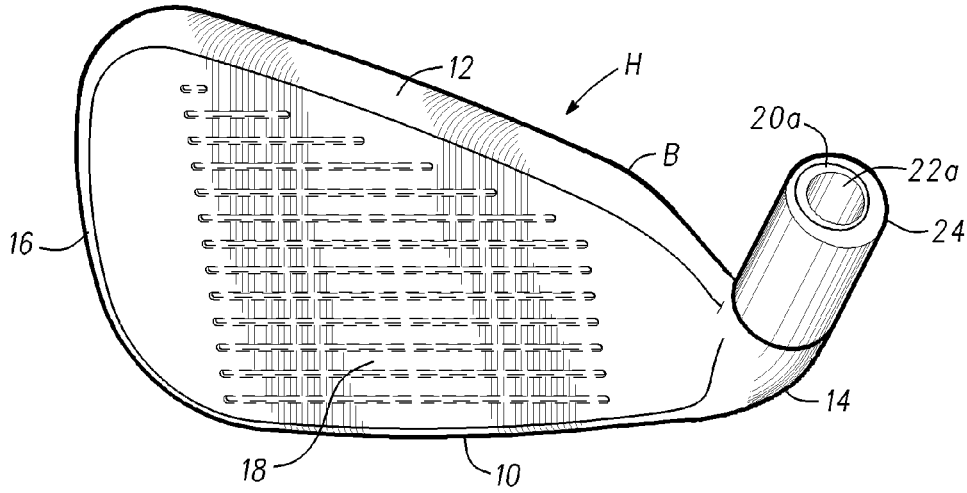
FIGS. 12-15 are views similar to FIGS. 1-4 showing the hosel weight mounted on an alternative golf club head.
Figure 13:
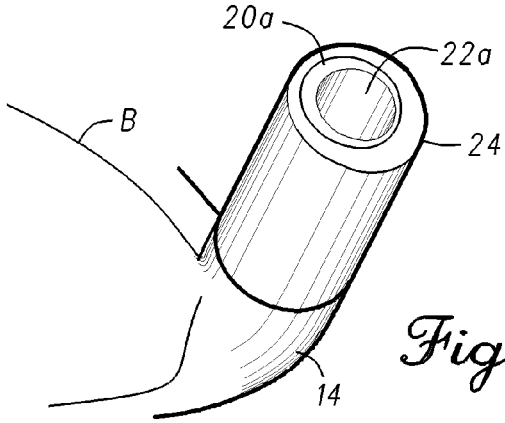
Figure 14:
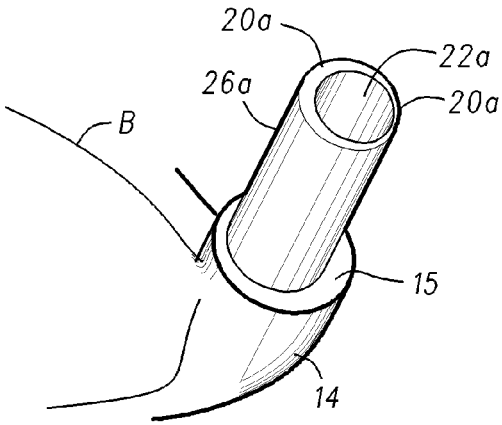
Figure 15:
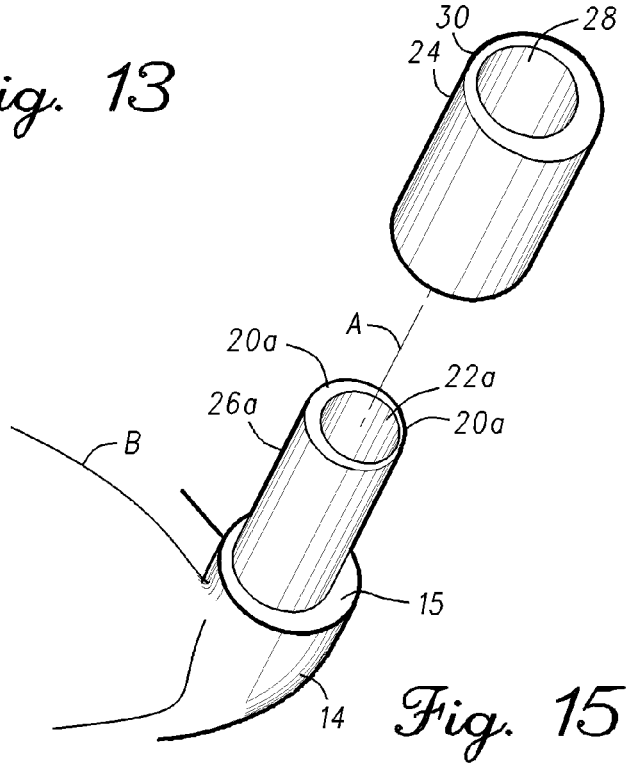
Figure 16:
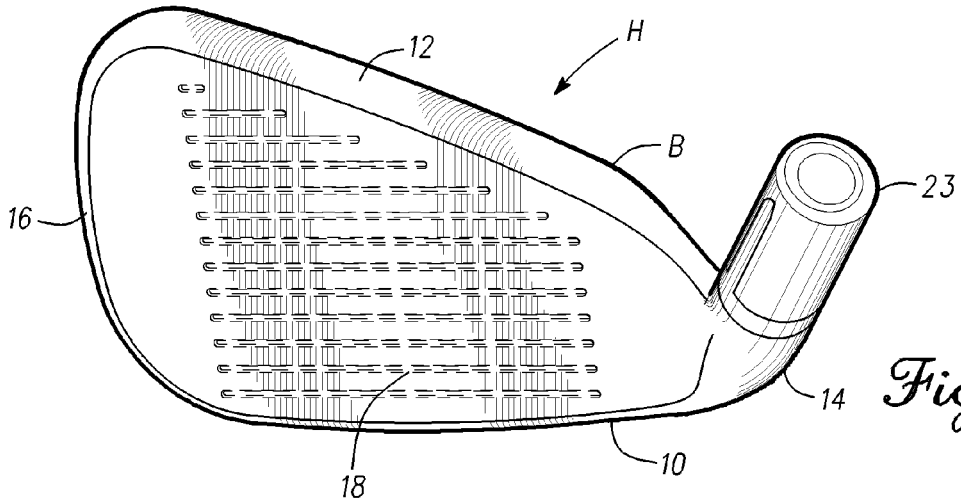
FIG. 16 is a perspective view of a golf club head incorporating another embodiment of a hosel weight according to the present invention.
Figure 17:
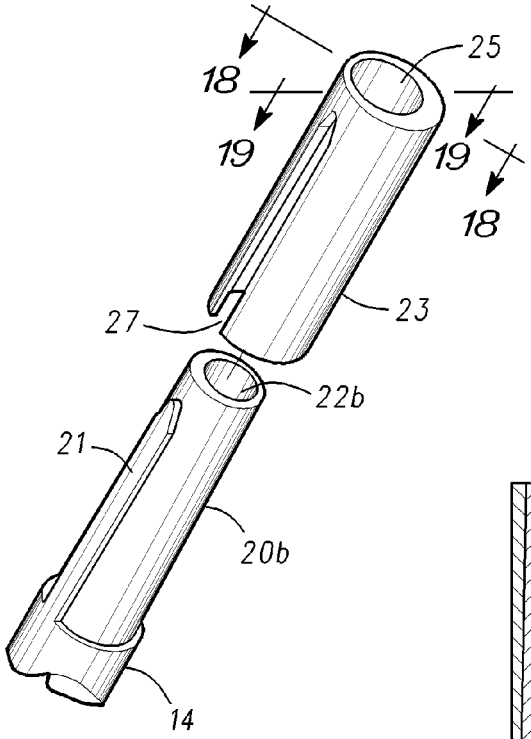
FIG. 17 is an exploded view of the heel portion of the golf club head shown in FIG. 16.

With reference to FIGS. 9-11, hosel weights 24*a*, 24*b* and 24*c* are similar to hosel weight 24 except that their bores 28*a*, 28*b* and 28*c* have different shapes than the cylindrical bore 28 in hosel weight 24. For example, the bore 28*a* in hosel weight 24*a* is rectangular and the longitudinal axis C of the hosel weight 24*a* is offset from the hosel longitudinal axis A by a distance D1. The bore 28*b* in hosel weight 24*b* is polygonal and the longitudinal axis C of the hosel weight 24*b* is offset from the hosel longitudinal axis A by a distance D2. The bore 28*c* in hosel weight 24*c* is elliptical and the longitudinal axis C of the hosel weight 24*c* is offset from the hosel longitudinal axis A by a distance D3. In the hosel weights 24*a*, 24*b* and 24*c*, the peripheral walls 30*a*, 30*b* and 30*c* that define the bores 28*a*, 28*b* and 28*c* have a thickness dimension T1 at their thickest point and a thickness dimension T2 at their thinnest point. In each of the hosel weights 24*a*, 24*b* and 24*c*, thickness dimension T1 is greater than thickness dimension T2.

It will be understood that when using the hosel weights 24*a*, 24*b* and 24*c*, the hosel 20 will be modified to have an outer shape that is complimentary to the bores 28*a*, 28*b* and 28*c*. For example, when using the hosel weight 24*a*, the hosel 20 will be modified to have a generally rectangular outer shape. When using the hosel weight 24*b*, the hosel 20 will be modified to have a generally polygonal shape and, when using the hosel weight 24*c*, the hosel 20 will be modified to have a generally elliptical outer shape.

Referring to FIGS. 12-15, the hosel weight 24 is mounted on a golf club head H having a different hosel 20*a* with a bore 22*a* that is offset (i.e. not concentric) with respect to the longitudinal axis A of the hosel 20*a*. This offset results in the peripheral wall 26*a* of the hosel 20*a* having a varying thickness dimension similar to the varying thickness dimension of the peripheral wall 30 of the hosel weight 24. The combination of the hosel 20*a* and the hosel weight 24 results in the bore 22*a* being centered (instead of offset) with respect to the outer periphery of the hosel weight 24 when the hosel weight 24 is in the position shown in FIG. 5.

Figure 18:
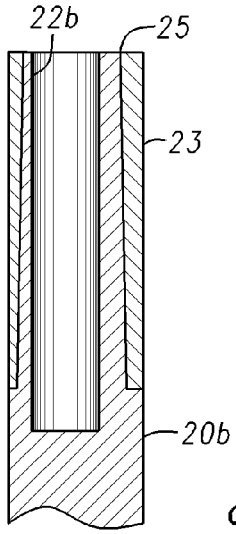
FIG. 18 is a cross sectional view taken along lines 18-18 in FIG. 17.
Figure 19:
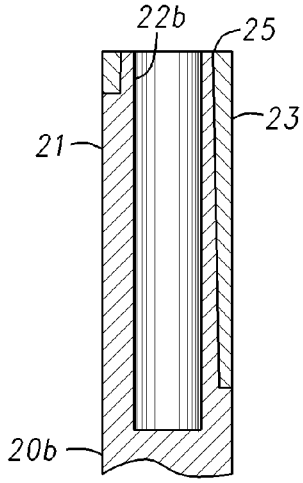
FIG. 19 is a cross sectional view taken along lines 19-19 in FIG. 17.

With reference to FIGS. 16-19, an iron-type golf club head H includes a body B with a sole 10, a top edge 12, a heel portion 14, a toe portion 16 and a front face 18 as described above. The golf club head H also includes a hosel 20*b* on the body heel portion 14 with a bore 22*b* for receiving the end of a golf club shaft (not shown). The bore 22*b* is offset (i.e. not concentric) relative to the longitudinal axis of the hosel 20*b*. An elongated lug 21 is provided on one side of the hosel 20*b*. A hosel weight 23 includes an offset bore 25 that receives the hosel 20*b*. A slot 27 extends along one side of the hosel weight 23 and receives the lug 21 in order to lock the hosel weight 23 in position on the hosel 20*b* and prevent it from rotating. As seen in FIG. 18, the hosel 20*b* is tapered from bottom to top and the bore 25 in the hosel weight 23 increases in diameter from top to bottom in order to match the taper of the hosel 20*b*.

What is claimed is:

1. A golf club head comprising:

a body having a heel portion, a toe portion and a front face extending between the heel and toe portions for impacting a golf ball;

the body including a hosel having a hosel longitudinal axis and a hosel bore for receiving an end of a golf club shaft; and a hosel weight mounted on the hosel, the hosel weight comprising a hosel weight longitudinal axis and a hosel weight bore for receiving the hosel, the hosel weight bore comprising a hosel weight bore longitudinal axis offset from the hosel weight longitudinal axis, and the hosel weight longitudinal axis being offset from the hosel longitudinal axis;

wherein:

a single piece of the body comprises the heel portion and the hosel;

the single piece of the body is made of a material having a first density;

the hosel weight is made of a material having a second density; and the second density is greater than the first density, and wherein said hosel weight is straight and either generally cylindrical or conical along an entire length of said hosel weight when on said hosel.

2. The golf club head of claim 1, wherein:

the hosel bore is offset with respect to said the hosel longitudinal axis.

3. The golf club head of claim 2, wherein:

the hosel has a peripheral wall defining its hosel bore, and the hosel peripheral wall has a varying thickness dimension.

4. The golf club head of claim 1, wherein:

the hosel weight bore runs parallel to the hosel weight longitudinal axis, the hosel weight has a peripheral wall defining the hosel weight bore, and the hosel weight peripheral wall has a varying thickness dimension.

5. The golf club head of claim 4, wherein:

the hosel bore and the hosel weight bore are concentric with the hosel longitudinal axis.

6. The golf club head of claim 1, wherein:

the body is made of titanium and wherein the hosel weight is made of tungsten.

7. The golf club head of claim 1, wherein:

the hosel weight longitudinal axis is offset relative to the hosel longitudinal axis in at least one of:

a first direction extending generally from the body toe portion toward the body heel portion, a second direction extending generally from the body heel portion toward the body toe portion, a third direction extending generally forwardly relative to the front face, or a fourth direction extending generally rearwardly relative to the front face.

8. The golf club head of claim 7, wherein the hosel weight longitudinal axis is offset with respect to the hosel longitudinal axis in the first direction extending generally from the body toe portion toward the body heel portion.

9. The golf club head of claim 1, wherein:

the hosel weight bore is circular; and the hosel bore is offset with respect to the hosel longitudinal axis.

10. The golf club head of claim 1, wherein:

the hosel includes a lug formed on one side thereof, and the hosel weight includes a slot extending along one side thereof for receiving the lug.

11. The golf club head of claim 1, wherein:

the hosel weight bore longitudinal axis is parallel to the hosel weight longitudinal axis.

12. The golf club head of claim 1, wherein:

the hosel weight bore longitudinal axis is parallel with the hosel longitudinal axis.

13. An iron-type golf club head comprising:

a body having a sole, a top edge, a heel portion, a toe portion and a front face extending between said heel and toe portions for impacting a golf ball;

said body including a hosel adjacent said heel portion, said hosel having a hosel longitudinal axis and a hosel bore for receiving one end of a golf club shaft; and a hosel weight mounted on said hosel, said hosel weight having a hosel weight longitudinal axis and a hosel weight bore for receiving said hosel, said hosel weight longitudinal axis being offset relative to said hosel longitudinal axis;

wherein:

the body is made of a material having a first density;

the hosel weight is made of a material having a second density; and the second density is greater than said first density, and wherein said hosel weight is straight and either generally cylindrical or conical along an entire length of said hosel weight when on said hosel.

14. The iron-type golf club head of claim 13, wherein the hosel weight bore is offset with respect to said hosel weight longitudinal axis.

15. The iron-type golf club head of claim 14, wherein said hosel weight has a peripheral wall defining its bore, and wherein said hosel weight peripheral wall has a varying thickness dimension.

16. The iron-type golf club head of claim 15, wherein the hosel bore and the hosel weight bore are concentric with the hosel longitudinal axis.

17. The iron-type golf club head of claim 14, wherein the hosel bore is offset with respect to said hosel longitudinal axis.

18. The iron-type golf club head of claim 17, wherein said hosel has a peripheral wall defining its hosel bore, and wherein said hosel peripheral wall has a varying thickness dimension.

19. The iron-type golf club head of claim 13, wherein said body is made of steel and wherein said hosel weight is made of tungsten.

20. The iron-type golf club head of claim 13, wherein said body is made of titanium and wherein said hosel weight is made of tungsten.

21. The iron-type golf club head of claim 13, wherein said body is made of a composite material and wherein said hosel weight is made of metal.

22. The iron-type golf club head of claim 13, wherein said body is made of a composite material and wherein said hosel weight is made of another composite material.

23. The iron-type golf club head of claim 13, wherein:

said hosel weight longitudinal axis is offset relative to said hosel longitudinal axis in one of:

a first direction extending generally from said body toe portion toward said body heel portion, a second direction extending generally from said body heel portion toward said body toe portion, a third direction extending generally forwardly relative to said front face, or a fourth direction extending generally rearwardly relative to said front face.

24. The iron-type golf club head of claim 23, wherein said hosel weight longitudinal axis is offset with respect to said hosel longitudinal axis in the first direction extending generally from said body toe portion toward said body heel portion.

25. The iron-type golf club head of claim 23, wherein said hosel weight longitudinal axis is offset with respect to said hosel longitudinal axis in the second direction extending generally from said body heel portion toward said body toe portion.

26. The iron-type golf club head of claim 23, wherein said hosel weight longitudinal axis is offset with respect to said hosel longitudinal axis in the third direction extending generally forwardly relative to said front face.

27. The iron-type golf club head of claim 23, wherein said hosel weight longitudinal axis is offset with respect to said hosel longitudinal axis in the fourth direction extending generally rearwardly relative to said front face.

28. The iron-type golf club head of claim 13, wherein:

the hosel weight bore comprises a hosel weight bore longitudinal axis different than the hosel weight longitudinal axis; and the hosel weight bore longitudinal axis is parallel to the hosel weight longitudinal axis.

29. The iron-type golf club head of claim 13, wherein:

the hosel weight bore comprises a hosel weight bore longitudinal axis different than the hosel weight longitudinal axis; and the hosel weight bore longitudinal axis is parallel with the hosel longitudinal axis.

30. The iron-type golf club head of claim 13, wherein:

the hosel weight bore is at least one of circular, rectangular, polygonal, or elliptical; and the hosel bore is offset with respect to said hosel longitudinal axis.

31. A method of making an iron-type golf club head, the method comprising:

providing a body having a heel portion, a toe portion, a front face extending between the heel and toe portions for impacting a golf ball, and a hosel having a hosel longitudinal axis and a hosel bore for receiving one end of a golf club shaft; and providing a hosel weight having a hosel weight longitudinal axis and mountable on the hosel so that a hosel weight bore in the hosel weight receives the hosel along a hosel weight bore longitudinal axis of the hosel weight bore, the hosel weight longitudinal axis being offset relative to the hosel longitudinal axis, and the hosel weight longitudinal axis being offset relative to the hosel weight bore longitudinal axis;

wherein:

providing the body comprises:

providing a single piece of the body to comprise the heel portion and the hosel;

the single piece of the body is made of a material having a first density;

the hosel weight is made of a material having a second density; and the second density is greater than the first density, and wherein said hosel weight is straight and either generally cylindrical or conical along an entire length of said hosel weight when on said hosel.

32. The method of claim 31, wherein:

the hosel weight longitudinal axis is offset relative to the hosel longitudinal axis in at least one of:

a first direction extending generally from the body toe portion toward the body heel portion, a second direction extending generally from the body heel portion toward the body toe portion, a third direction extending generally forwardly relative to the front face, or a fourth direction extending generally rearwardly relative to the front face.

33. The method of claim 31, wherein:

the body comprises a titanium material; and the hosel weight comprises a tungsten material.

* * * * *